US008118478B2

(12) United States Patent
Mott et al.

(10) Patent No.: US 8,118,478 B2
(45) Date of Patent: Feb. 21, 2012

(54) MOUNTING ASSEMBLY FOR PLASTIC BULK CONTAINER

(76) Inventors: Charles Brian Mott, Surrey (CA); Charles Eric Mott, Vancouver (CA); Shaun Mott, Vancouver (CA)

( * ) Notice: Subject to any disclaimer, the term of this patent is extended or adjusted under 35 U.S.C. 154(b) by 0 days.

(21) Appl. No.: 12/945,725

(22) Filed: Nov. 12, 2010

(65) Prior Publication Data

US 2011/0110182 A1 May 12, 2011

Related U.S. Application Data

(63) Continuation of application No. 11/697,709, filed on Apr. 7, 2007, now Pat. No. 7,832,923, which is a continuation-in-part of application No. 10/730,062, filed on Dec. 9, 2003, now abandoned.

(60) Provisional application No. 60/431,688, filed on Dec. 9, 2002.

(51) Int. Cl.
*B01F 7/16* (2006.01)

(52) U.S. Cl. ..... 366/245; 366/249; 366/331; 366/347

(58) Field of Classification Search ..... 366/331, 366/347, 242, 244, 245, 247, 249
See application file for complete search history.

(56) References Cited

U.S. PATENT DOCUMENTS

| | | | | |
|---|---|---|---|---|
| 1,351,243 | A * | 8/1920 | Craves | 366/251 |
| 2,060,277 | A * | 11/1936 | Butts | 366/251 |
| 2,450,107 | A * | 9/1948 | Bostwick | 366/249 |
| 2,681,211 | A * | 6/1954 | Reynolds | 366/251 |
| 2,793,012 | A | 5/1957 | Wolf | |
| 3,115,664 | A | 12/1963 | Del Ponte | |
| 3,209,387 | A | 10/1965 | Lukesch | |
| 3,411,756 | A * | 11/1968 | Ziegler | 366/251 |
| 3,572,651 | A | 3/1971 | Harker | |
| 3,622,129 | A | 11/1971 | Mazowski | |
| 3,649,465 | A | 3/1972 | Scharf et al. | |
| 3,831,850 | A | 8/1974 | Hunter | |
| 3,975,239 | A | 8/1976 | Stamer | |
| 4,204,774 | A | 5/1980 | de Bruyne | |
| 4,355,906 | A | 10/1982 | Ono | |
| 4,596,779 | A | 6/1986 | Ono | |
| 5,193,908 | A | 3/1993 | Rescorla et al. | |
| 5,618,107 | A | 4/1997 | Bartsch | |
| 6,860,193 | B1 * | 3/2005 | Kim | 366/331 |
| 2004/0223405 | A1 | 11/2004 | Mott | |

OTHER PUBLICATIONS

Notice of Allowance mailed Jul. 2, 2010, for U.S. Appl. No. 11/697,709.
Office Action mailed Sep. 8, 2005, for U.S. Appl. No. 10/730,062.

(Continued)

*Primary Examiner* — Tony G Soohoo
(74) *Attorney, Agent, or Firm* — Schwabe, Williamson & Wyatt, P.C.

(57) ABSTRACT

A mounting and coupling assembly for a mixer for in a container having an impeller connected to a drive shaft, in an assembly, which extends through an opening into the container. The assembly includes a lip mount to stabilize and support the mixer on the lip of said container. A cover secures said lip mount with threaded fasteners engaging complementary fasteners on the container neck and clamping the plate to the container lip. A primary objective of the invention is to allow the stable mounting of a mixing unit to bulk containers and allow easy and safe coupling of a power module to the mixing assembly.

5 Claims, 10 Drawing Sheets

OTHER PUBLICATIONS

Final Office Action mailed Mar. 29, 2006, for U.S. Appl. No. 10/730,062.

Final Office Action mailed Oct. 10, 2006, for U.S. Appl. No. 10/730,062.

* cited by examiner

Fig 4A
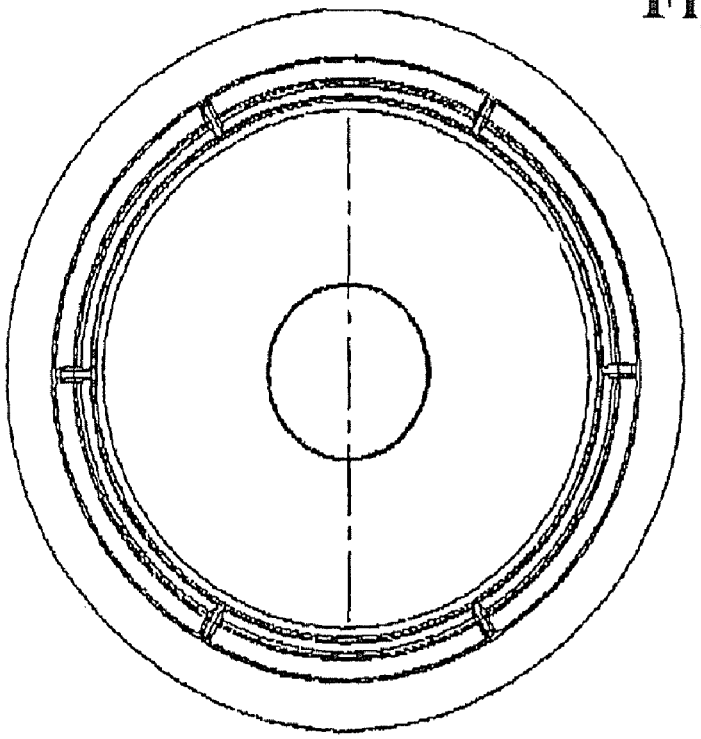
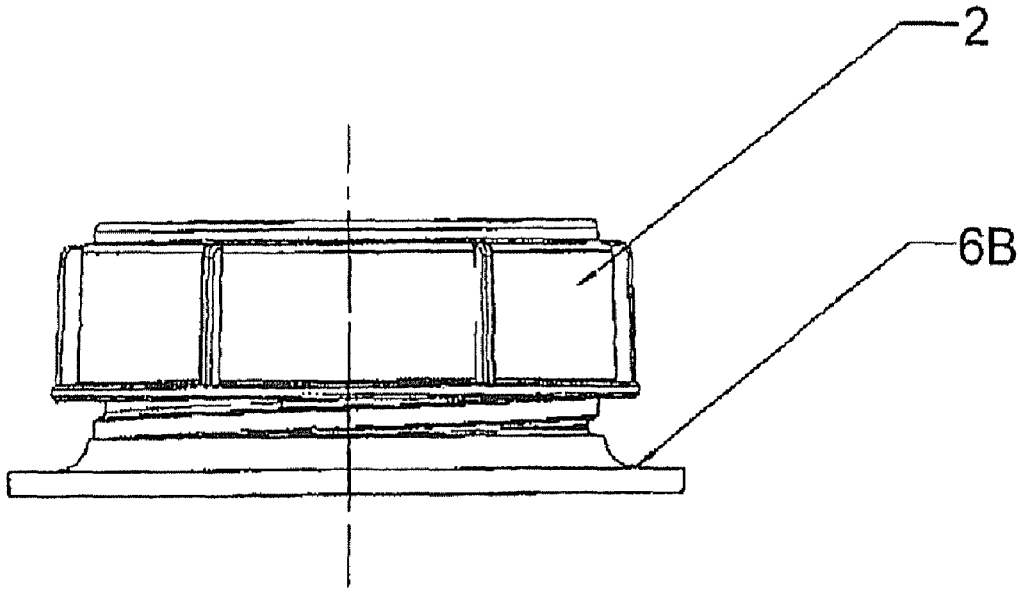
Fig 4B

MOUNTING ASSEMBLY FOR PLASTIC BULK CONTAINER

This application is a continuation of application Ser. No. 11/697,709, filed Apr. 7, 2007, now patented as U.S. Pat. No. 7,832,923, which is a continuation-in-part of application Ser. No. 10/730,062, filed Dec. 9, 2003, now abandoned, and claims the benefit of Provisional application No. 60/431,688, filed Dec. 9, 2002, which are incorporated herein by reference.

FIELD OF THE INVENTION

The present invention relates generally to fluid mixing units. More particularly, the present invention relates to apparatus employed in conjunction with containers for agitating, mixing and/or blending of fluids. Yet more particularly, the present invention relates to an assembly for fluid mixing units wherein a mixing assembly is affixed to a container for fluids.

BACKGROUND

Many industries transport, store, mix, process and/or discharge fluids from commercial bulk containers made of plastic or metal, commonly known in the trade as "tote boxes", "bulk containers", or "intermediate bulk containers" (all herein referred to as "containers"). It is often desirable, and in some cases required, that the fluids stored in such containers be agitated, mixed or blended between the time they are loaded into the containers and the time they are discharged therefrom. To affect the desired mixing, according to the prior art, it was necessary to open the container and insert a mixing unit with impeller blades. There are, however, several drawbacks to this approach.

A first disadvantage of mixing assemblies used in the art is that as a plurality of containers are usually stored in close proximity, it may be difficult to access the selected container to remove the cover of the access opening or port and to insert the mixing unit. Even if the cover of the opening is readily accessible, it may be difficult to remove the cover, particularly if the material in the container is highly volatile and the lid or port had been sealed to retain vapors.

Furthermore, the diameter of the access opening through which the mixing unit is inserted must be of sufficient diameter to allow the insertion of the impeller blades. In addition, if the container is substantially full, the mixing assembly has to be operated with considerable care so as not to splash, or otherwise spill, the contents of the container. This often requires operating the mixing assembly at speeds and power settings insufficient to properly agitate or mix the contents of the container.

Mixing units, including the drives and impellers (which are usually a single unit), are usually used with multiple containers and require extensive cleaning each time they are moved from one container to another. At present the containers and mixing units are cleaned after each use, resulting in high costs (both environmentally and in equipment/manpower). For many fluids used in the paint, chemical, and pharmaceutical industries the slightest contaminant left from ineffective cleaning may ruin the fluids in the container. Further substantial costs are also incurred through the expense of using and disposing of cleaning agents such as solvents. Finally, there is a manpower cost in the amount of time required to open, mix, close and seal each container.

Another mount for mixing units in the prior art is a bridge mounting that supports the mixing unit above the vessel neck.

These mounts also do not seal the container completely thereby allowing contaminants to enter the container.

Another solution in the prior art is the use of fully enclosed mixing units within stainless steel bulk containers. Unlike plastic containers, steel containers require extensive and often imperfect cleaning after each use which may contaminate the container contents. The use and disposal of powerful solvents and cleaning agents also create a large cost.

Another solution in the prior art is to support mixers by the use of expensive threaded metal lids for mounting the mixer. These lids rely on the threads of the neck and collar of the container to support the loads applied during mixing and often result in cracking of the bulk container and failure of the mount.

Yet another method of mixer support is a clamping device positioned around the neck of the container. This may cause difficulties as the clamping shoe inside the housing may collapse the neck of the container. Alternatively, this mount may also rotate on the neck of the container.

What is needed is an assembly that seals the container, and does not require any additional support means other than the container itself. Additionally what is needed is a power module that can be detachably secured to the container and mixing assembly.

SUMMARY OF THE INVENTION

According to the invention, a mounting assembly for a container with a lip is provided, comprising a rigid lip mount shaped to fit on top of said lip, said lip mount defining an aperture shaped to engage a housing for a shaft; a cover for the container, said cover shaped to secure said lip mount to the lip by threadably engaging with the neck, said cover defining an aperture shaped to allow passage of said housing; and mixing means comprising a shaft with a housing, a motor and an impeller. This assembly provides a fully enclosed mixing mount for use inside the container. The lip mount allows for mixing in the container while preserving the integrity of the container (when compared to a threaded metal lid mount), and for a low cost (when compared to a stainless steel bulk container, or the recycling process involved in prior art mixing assemblies). It is, therefore, a primary object of the present invention to provide a mixing assembly, which facilitates agitating, mixing and/or blending of fluids that are shipped and stored in containers.

Another object of the present invention is to provide a mixing unit, which permits a mixing assembly to be easily, and if desired, permanently, affixed to a container and that is readily accessible for operation by a power module that can be detachably secured to the mixing assembly.

It is yet another object of the present invention to provide a mixing assembly, as above, that allows the power module to be detachably secured to the mixing assembly such that there is no need for a person securing said power module to use tools, or to insert his or her hands in an area where injury could result.

It is yet a further object of the present invention to provide a mixing assembly that employs a locking means to prevent inadvertent disengagement of a fast make/break connector.

It is a still further object of the present invention to provide a mixing unit, as above, wherein the mixing assembly, when affixed to a container, presents a low profile so that it does not interfere with stacking of the containers.

In general, a mixing unit embodying the concepts of the present invention is adapted for use in conjunction with "tote vessel" containers or other containers of the type employed to store, mix and/or discharge fluids.

A mixing assembly may be relatively permanently affixed to such a container. The mixing assembly comprises a housing and an impeller shaft rotatably mounted within the bearing housing. One or more impellers are secured to the shaft and disposed interiorly in the container for rotation.

A fluid mixing unit embodying the concepts of the present invention is shown by way of example in the accompanying drawings and described in detail without attempting to show all of the various forms and modifications in which the invention might be embodied; the invention being measured by the appended claims and not by the details of the specification.

These and other objects of the invention, as well as the advantages thereof over existing and prior art forms, which will be apparent in view of the following detailed specification, are accomplished by means hereinafter described and claimed.

DESCRIPTION OF THE DRAWINGS

FIGS. 4*a* and 4*b* are side and bottom views, respectively of a cover therefor;

DETAILED DESCRIPTION

Figure 1A:
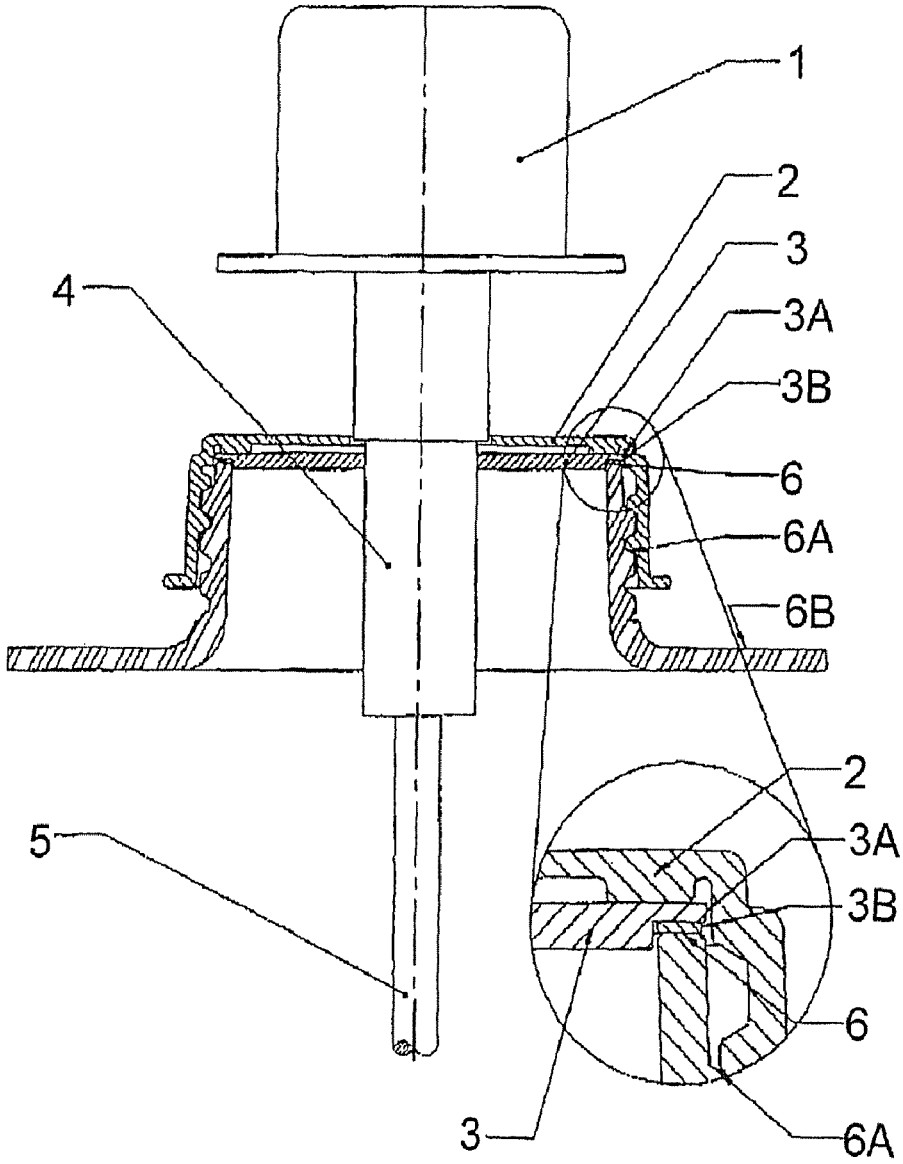
FIG. 1*a* is a side cross-sectional view of a first embodiment of an assembly according to the invention.
Figure 5:
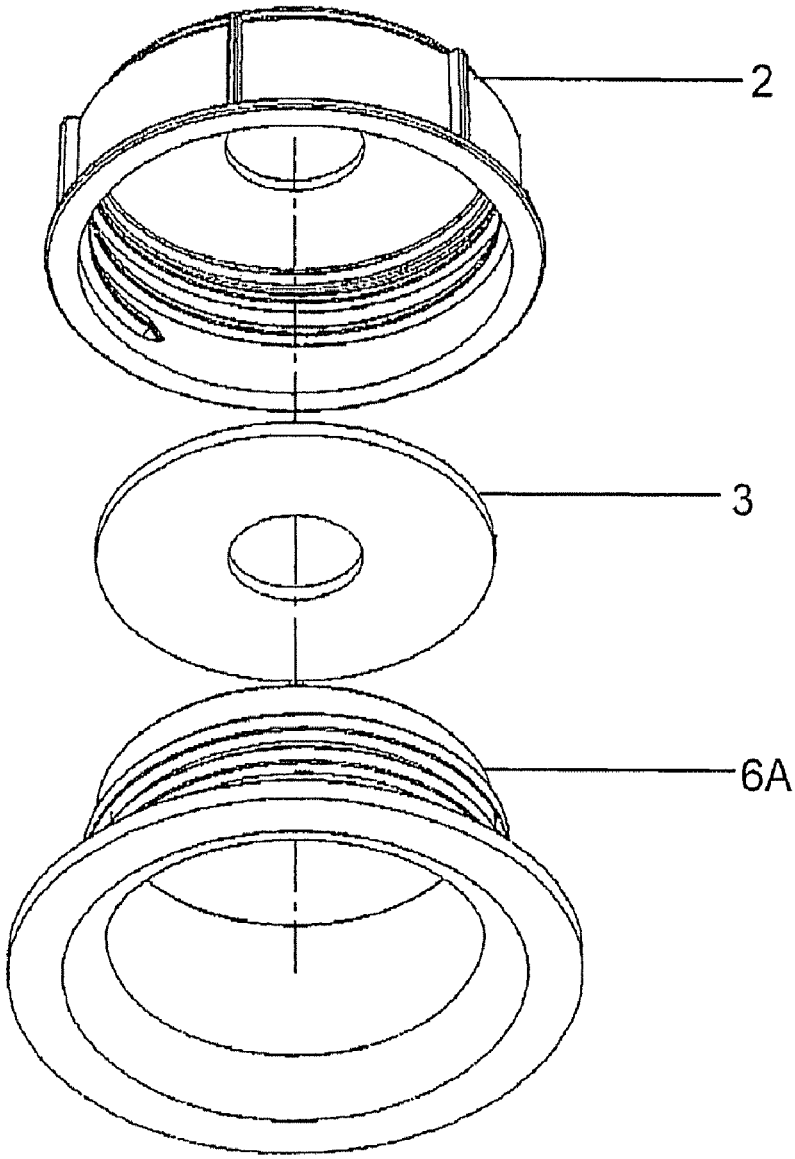
FIG. 5 is an exploded perspective view of a portion of the second embodiment of the assembly.

As seen in FIG. 1*a*, a first embodiment of the invention is an assembly, generally indicated as 10, for mounting mixing means to a container 6*b*. Mixing means may be of any kind found in the art, and generally comprise drive 1 or other propulsion device, a rotatable shaft 5, a housing 4 surrounding at least the upper portion of shaft 5, and impellers to mix the contents of container 6*b*. In this document, the terms "mixer" and "mixing means" will be used interchangeably. Container 6*b* is preferably made of plastic or steel, and may be any one of the many bulk containers available in the art. Container 6*b* is made to hold large amounts of material, usually fluids. The invention uses a lip mount 3 to stabilize and support the mixer on the lip 6 of container 6*b*. Lip mount 3 is generally disc shaped as best seen in FIG. 5 and is preferably made of a hard rigid material such as metal that can distribute the weight of the mixing means. Lip mount 3, when in position on lip 6, acts as a support for the mixer inserted through lip mount 3 into container 6*b*. Lip mount 3 preferably has a circumference equal to the outside diameter of lip 6 of neck 6*a* of container 6*b* such that lip mount 3 can rest on top of lip 6. Lip mount 3 may have an aperture sized to receive threaded mixer housing 4. Alternatively, housing 4 may be secured to lip mount 3 by welding or other securing means known in the art.

In a preferred embodiment of the invention, a gasket 3*b* is preferably secured by glue or other conventional means to the edge 3*a* of the underside of lip mount 3. Gasket 3*b* is positioned to engage the outer side of neck lip 6 to provide further support for lip mount 3. Lip mount 3 is positioned between the lip 6 of the cylindrical neck 6*a* of container 6*b*. Neck 6*a* has external screw threads, and receives cover 2, allowing cover 2 to act as a collar. Cover 2 secures lip mount 3 by engaging the threaded fasteners on the container neck 6*a* to hold lip mount 3 into position.

Figure 2A:
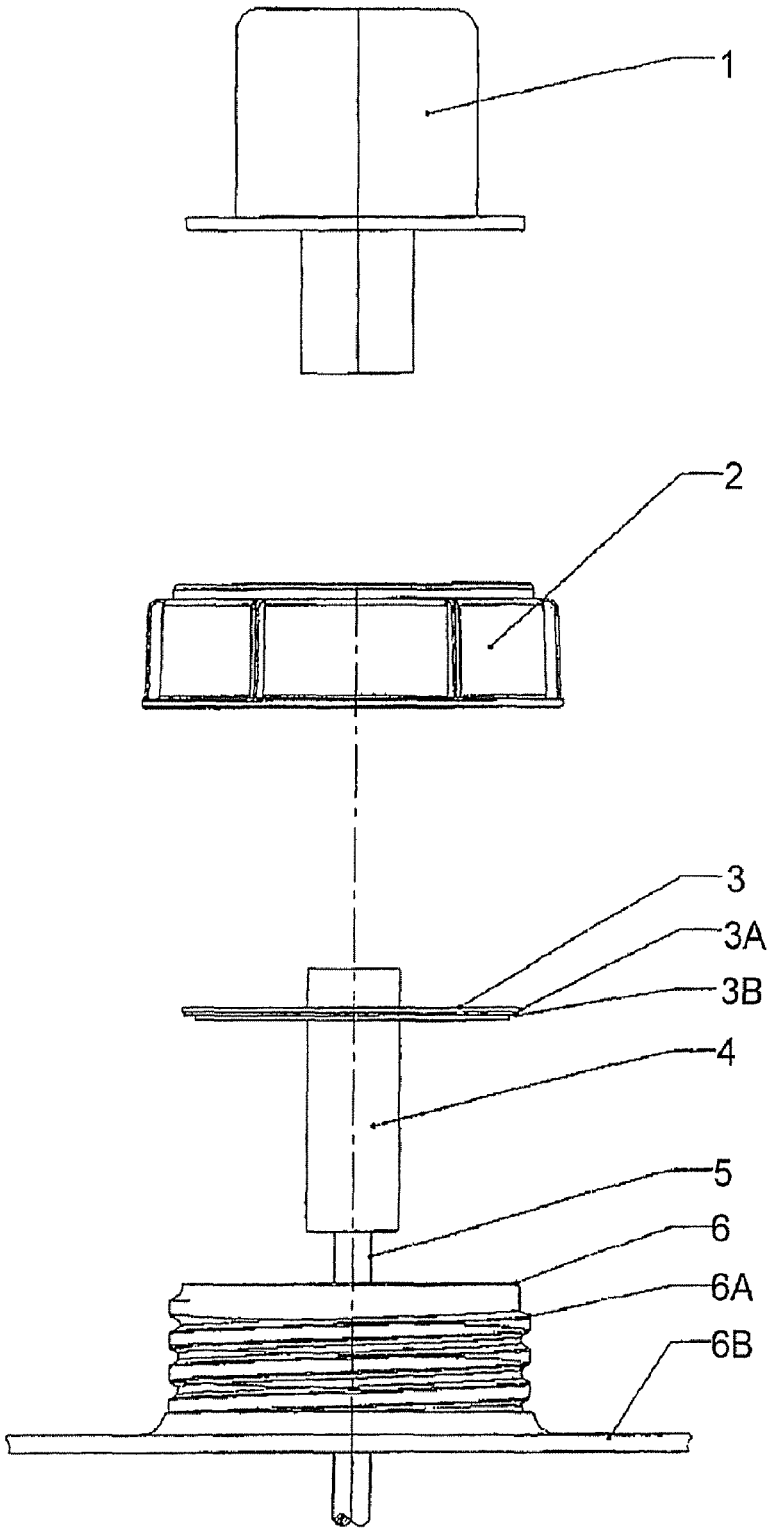
FIG. 2*a* is an exploded side view of the first embodiment.

As best seen in FIG. 2*a*, neck 6*a* extends from container 6*b*, and ends at lip 6. Mixer shaft 5 is inserted though neck 6*a* of container 6*b* to reach the interior of container 6*b*. The top of shaft 5 and housing 4 are supported and sealed in container 6*b* by lip mount 3, which allows the mixer assembly to rest on the cover 2 of the container 6*b*. Housing 4 is secured to lip mount 3 by securing means. In an alternative embodiment of the invention, lip mount 3 and housing 4 may be welded or manufactured in a single piece.

In a preferred embodiment, cover 2 threadably engages neck 6*a* and may be screwed on to neck 6*a* to compress lip mount 3 into place. Cover 2 may be included as part of the mixer and inserted above lip mount 3 and below mixer drive 1. This complete assembly may then be inserted into and onto lip 6 allowing cover 2 to be engaged as above.

Figure 3A:
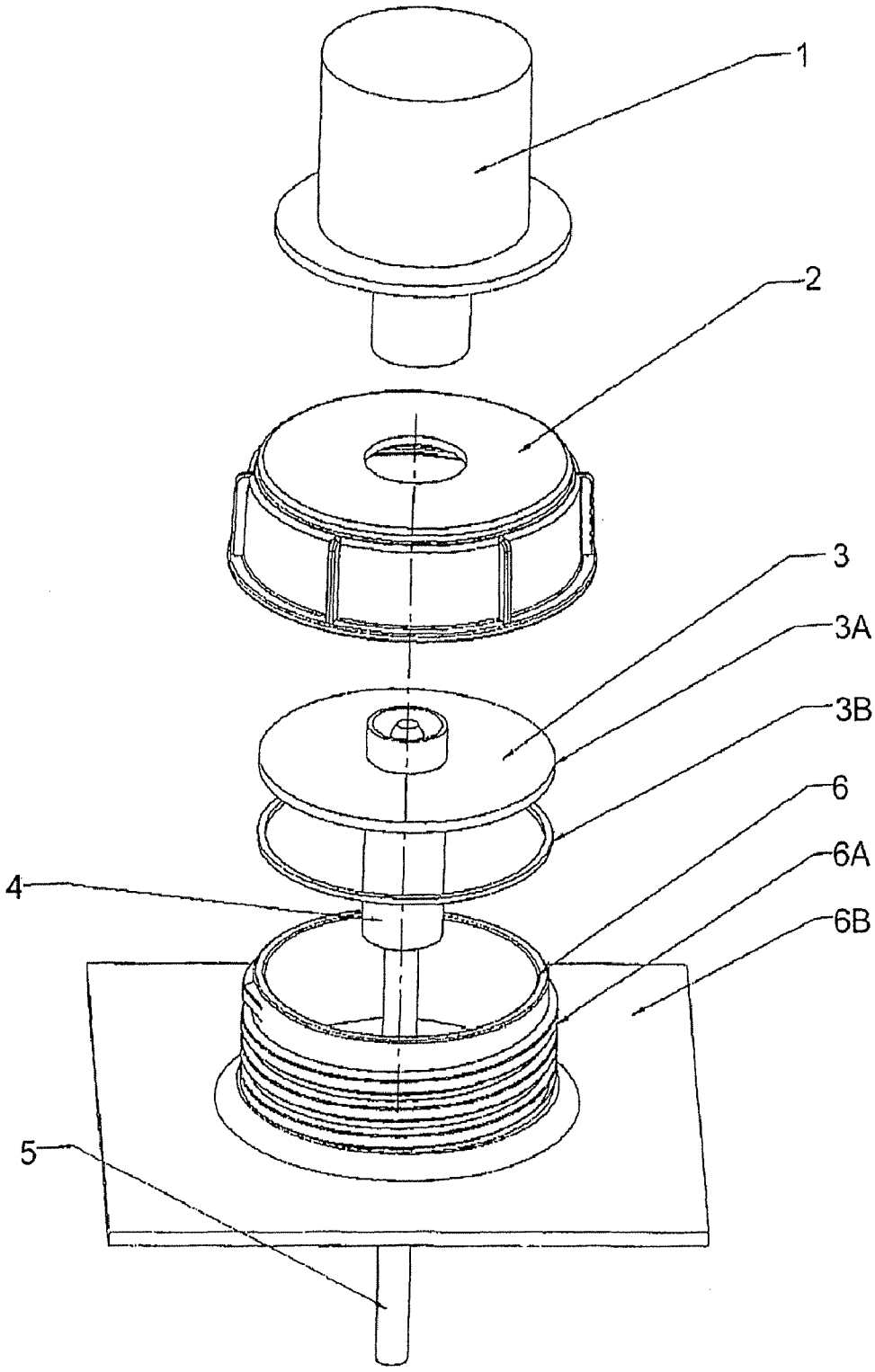
FIG. 3*a* is an exploded perspective view of the first embodiment.

As seen in FIG. 3*a*, housing 4 is engaged with lip mount 3 allowing shaft 5 to extend downwardly into container 6*b*. The bottom portion of mixer drive 1 couples with the top portion of housing 4, but lip mount 3 prevents mixer drive 1 from passing further into container 6*b*. In an alternative embodiment, housing 4 and lip mount 3 may be a single piece.

An embodiment of the invention includes an assembly for agitating, mixing and/or blending fluids affixed to container 6*b* using lip mount 3. Lip mount 3 is compressed between threaded container neck 6 and a threaded cover 2. The positioning of lip mount 3 between the container lip 6 and cover 2 causes the mixer 1 to be supported by the combined structure of both cover 2 and lip 6.

Shaft 5 is rotatably mounted in housing 4 to rotate an impeller secured to shaft 5. This impeller is sealed within the interior of the container 6*b*.

Figure 6:
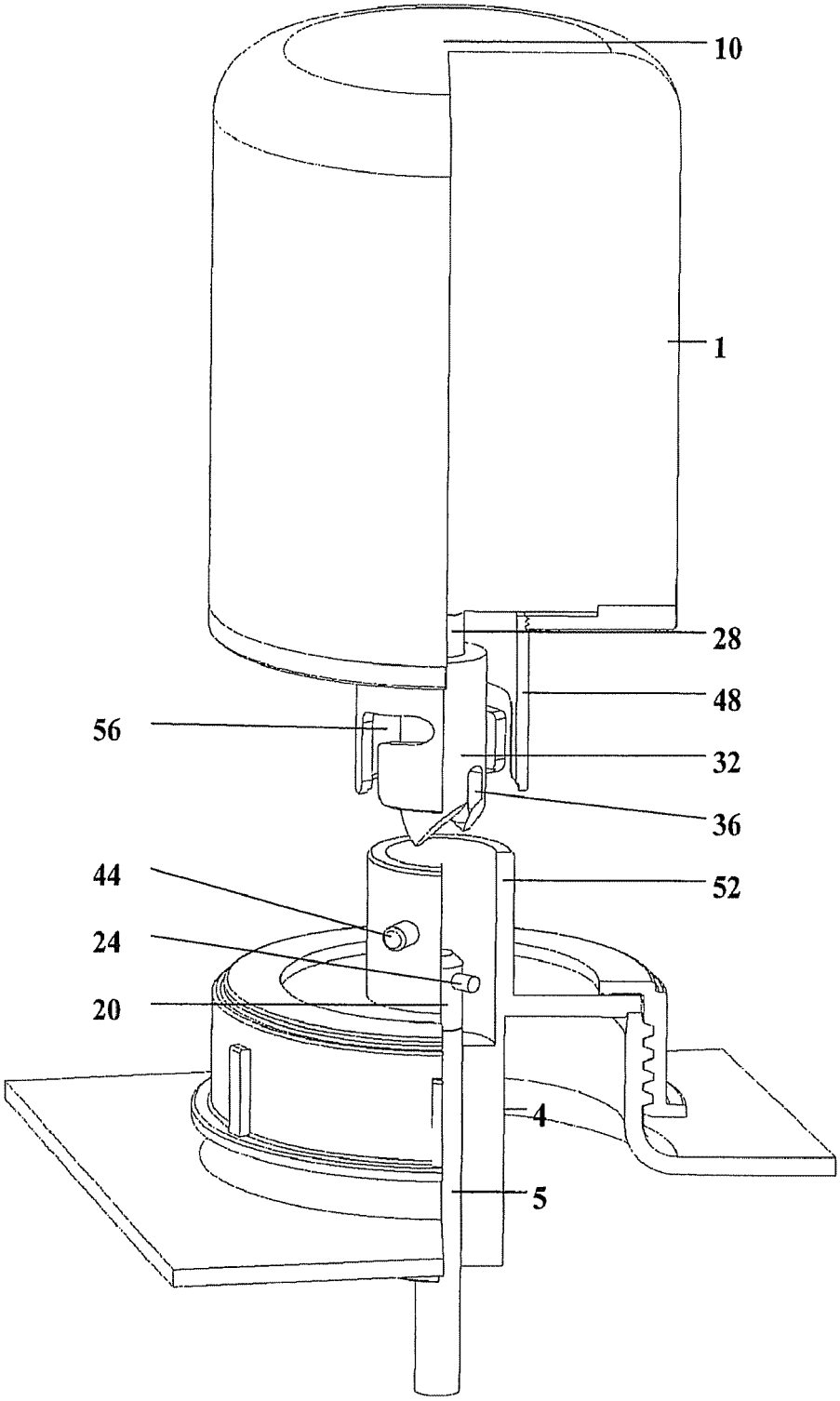
FIG. 6 is a perspective view of the coupling assembly prior to contact.
Figure 7:
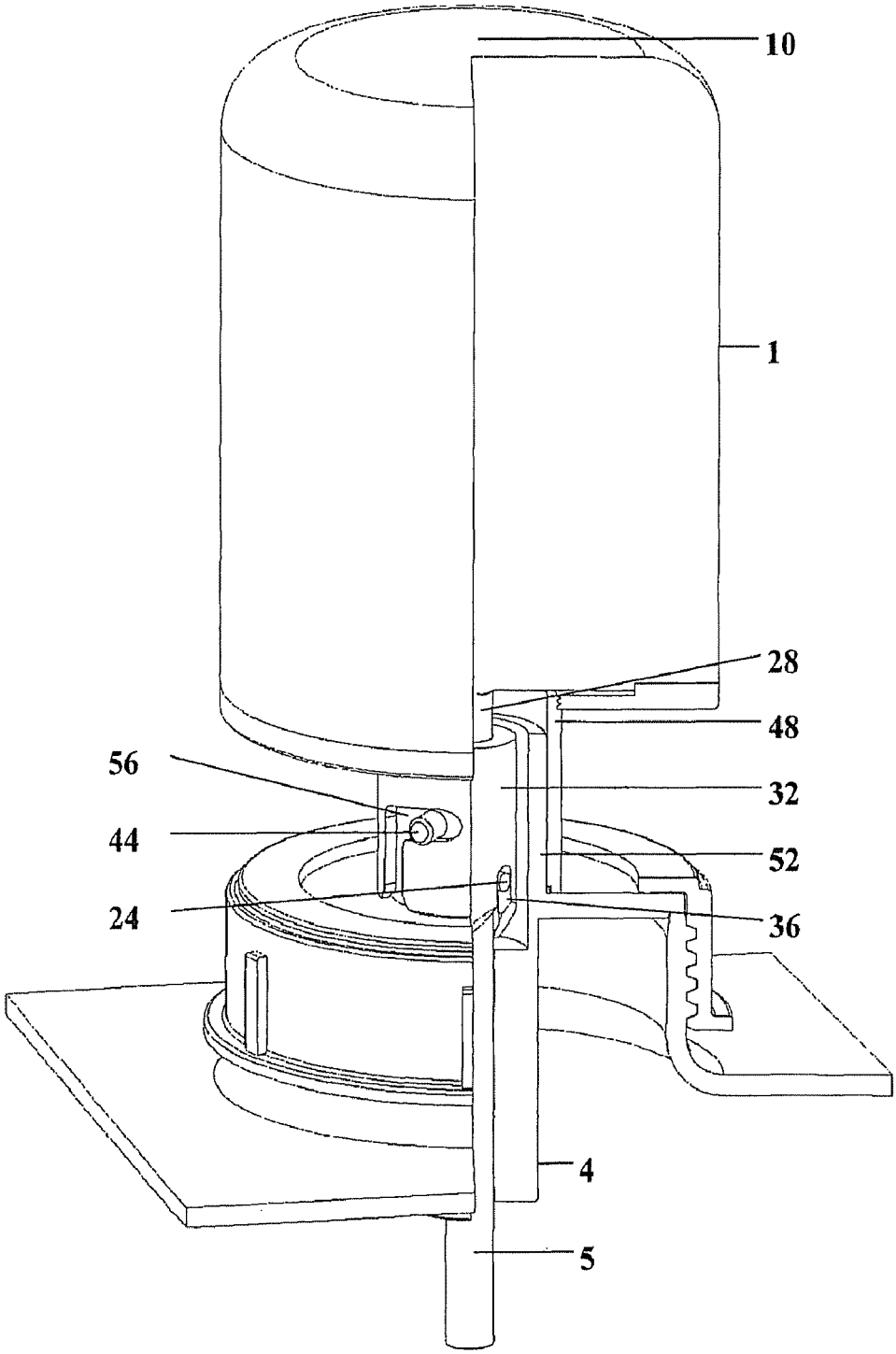
FIG. 7 is a perspective view of the coupling assembly secured to the coupling member.

The assembly also preferably includes a power module that is detachably secured to the mixing assembly by coupling assembly, generally indicated as 100, as seen in FIGS. 6 and 7. A preferred embodiment of coupling assembly 100 includes coupling member 20, as best seen in FIG. 6, positioned at the top of shaft 5, with coupling pin 24 positioned horizontally thereto. Drive shaft 28 of motor 1 extends downwardly therefrom and at its bottom end is shaft coupling member 32. Shaft coupling member 32 has groove 36 for receiving coupling pin 24.

Sheath 48 extends downwardly from motor 1 encompassing shaft coupling member 32. Sheath 48 is shaped to cover shaft coupling member 32. Sheath coupling member 52 is sized to receive sheath 48 and cover shaft coupling member 32. Sheath coupling member 52 preferably extends cylindrically from housing 4. Alternatively, sheath coupling member 52 may extend cylindrically from lip mount 3.

Sheath 48, as best seen in FIG. 7, has an L-shaped groove 56 to receive pin 44. When sheath coupling member 52 is secured to sheath 48 by pin 44 and groove 56, during operation of the mixing assembly 10, the rotation of drive shaft 28 assists in locking pin 44 with groove 56.

Sheath coupling member 52 is secured to housing 4 by securing means or may be part of housing means 4. In a preferred embodiment of the invention, the parts described above are easily replaceable and may be substituted should they become worn, or should an alternative securing means be used.

In use shaft coupling member 32 is lowered onto coupling member 20 such that coupling pin 24 is received by groove 36, as seen in FIG. 7. Pin 44 is simultaneously inserted into groove 56 to hold shaft coupling member 32 to shaft 5. Sheath 48 engages sheath coupling member 52 such that pin 44 is engaged by groove 56. Sheath 48 is then turned and groove 56 locks pin 44 in place thereby securing sheath 48 to sheath coupling member 52. When the agitator is operated to mix the liquid the drive motor 1 module drives agitator shaft 5.

An alternative embodiment of coupling assembly 100 (not shown), includes locking studs positioned on a mounting plate secured to the top surface of a lid to secure drive 1 to the lid. In this embodiment, the lid is used instead of cover 2. The lid has a generally flat cylindrical shape as is sized to cover the opening of the tote. A flange circumferentially extends from the bottom of sheath 48. This flange includes apertures to receive the locking studs on the mounting plate. After receiving the studs through the apertures, drive 1 can be rotated slightly allowing the studs to move to a smaller portion of the aperture to lock the studs in place on the mounting plate. The studs can then be tightened by nuts or the like, to further secure the flange to the mounting plate. Alternatively, rather than using a mounting plate, the studs can be part of the lid, allowing the flanges to be secured directly to the lid.

Figure 1B:
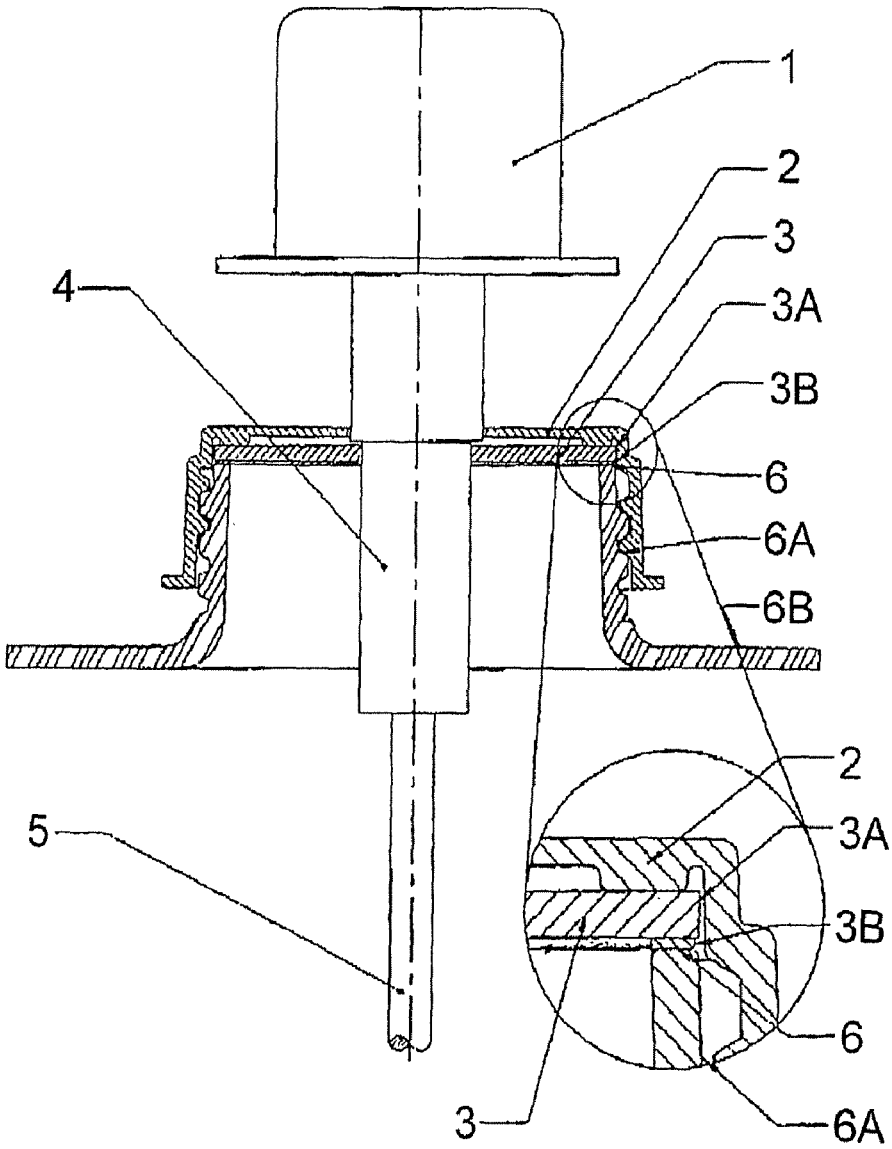
FIG. 1*b* is a side cross-sectional view of a second embodiment of an assembly according to the invention.
Figure 2B:
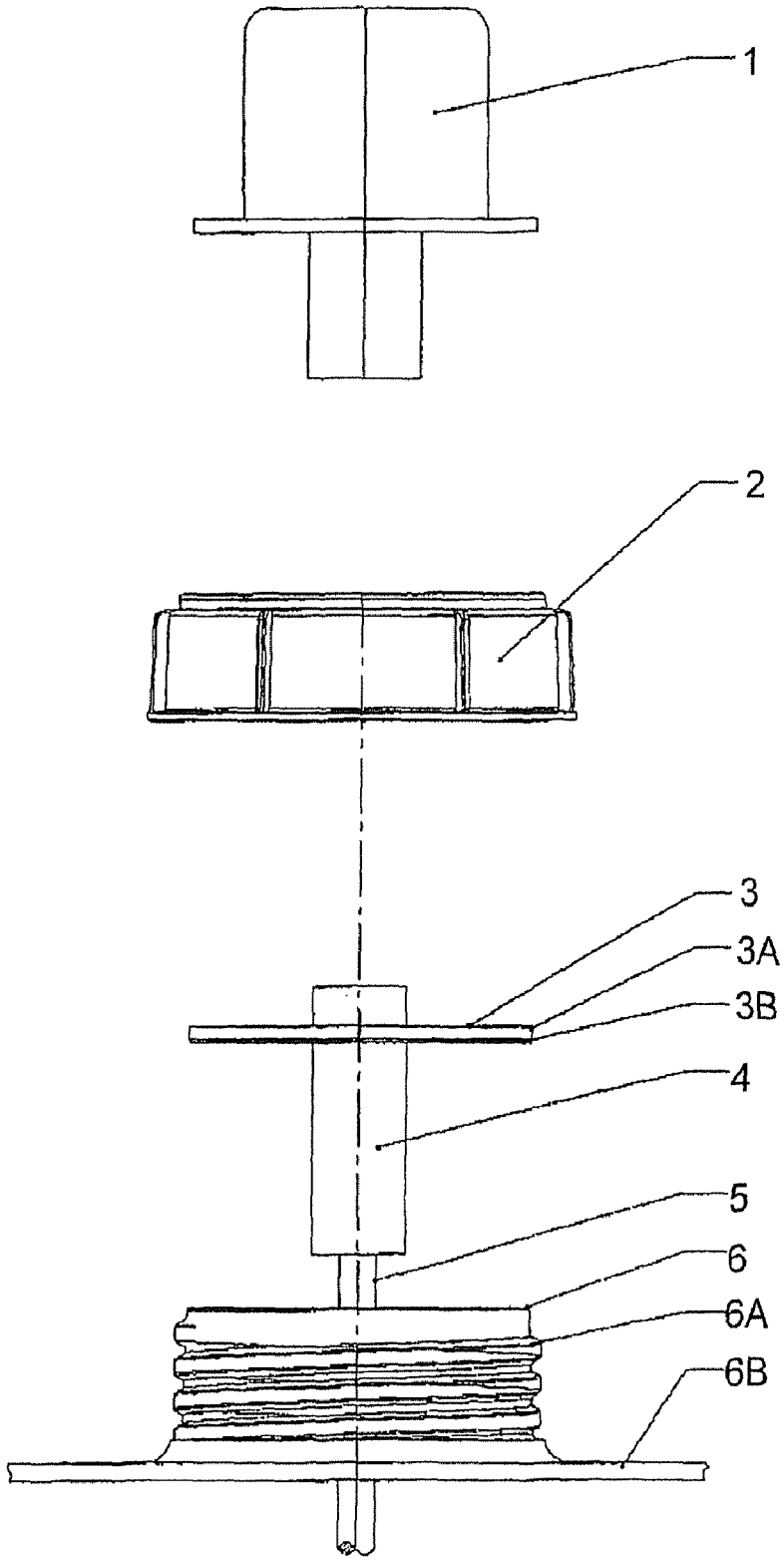
FIG. 2*b* is an exploded side view of the second embodiment.
Figure 3B:
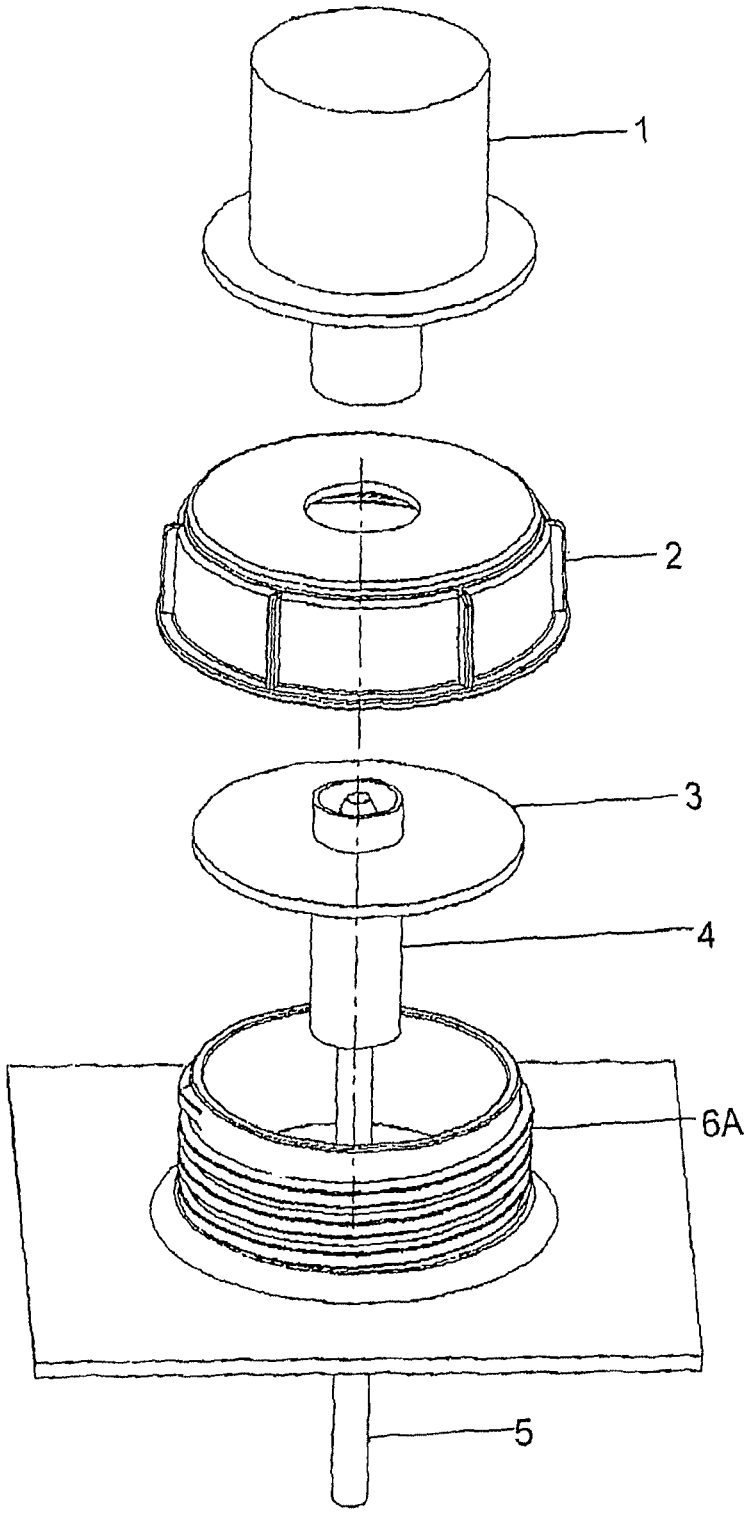
FIG. 3*b* is an exploded perspective view of the second embodiment.

In an alternative embodiment of the invention as seen in FIGS. 1*b*, 2*b*, and 3*b* no gasket is used. Instead the underside 8*b* of lip mount 3 may be padded to help it secure to lip 6. In yet another alternative embodiment, lip mount 3 may be molded to a particular shape to increase the ability to better handle pressure and to help secure lip mount 3 to lip 6.

As best seen in FIGS. 4*a* and 4*b* cover 2 is a standard cover for use with containers in the field. However, cover 2 has an aperture through which the bottom portion of mixer drive 1 and shaft 4 can pass. The assembly according to the invention positions the mixer in the center of cover 2 (as part of the cover) so that cover 2 can be rotated around the mixer, clamping the assembly into place.

As the cover is sealed, the contents may be pressurized and maintained under pressure as the mixing assembly is operated.

Container 6*b* may be made from plastic, steel or other material.

Preferably drive 1 will have a minimum protrusion to allow the containers to be stored in close proximity.

The assembly as described above is usually manufactured of plastic or a metal such as stainless steel.

Although the particular preferred embodiments of the invention have been disclosed in detail for illustrative purposes, it will be recognized that variations or modifications of the disclosed apparatus lie within the scope of the present invention.

The embodiments of the invention in which an exclusive property or privilege is claimed are defined as follows:

1. A mounting assembly and a mixer connected to the mounting assembly for a bulk container having a neck with a lip, comprising:

a. a rigid lip mount positioned entirely above said lip, said lip mount defining an aperture shaped to engage a housing for a shaft; said lip mount having an underside, said underside having padding at the edge of said lip mount, said padding positioned entirely below said lip mount;

b. a cover for the container, said cover shaped to secure said lip mount to the lip by engaging with the neck, said cover defining an aperture shaped to engage said housing;

wherein said mixer comprises said shaft with said housing, a motor and an impeller, said motor supported by said cover and said lip mount.

2. The mounting assembly of claim 1 wherein said lip mount is disc shaped.

3. The mounting assembly of claim 2 wherein said lip mount is made of metal.

4. The mounting assembly of claim 3 wherein said padding comprises a gasket shaped to support said lip mount on top of said lip.

5. The mounting assembly of claim 1 wherein said lip mount and said housing are secured as one piece.

* * * * *